US008052582B2

(12) United States Patent
Summers

(10) Patent No.: US 8,052,582 B2
(45) Date of Patent: Nov. 8, 2011

(54) TRAINING AND FITNESS APPARATUS

(75) Inventor: Neil Summers, Surrey (GB)

(73) Assignee: ENANEF Limited, Surrey (GB)

( * ) Notice: Subject to any disclaimer, the term of this patent is extended or adjusted under 35 U.S.C. 154(b) by 72 days.

(21) Appl. No.: 12/170,351

(22) Filed: Jul. 9, 2008

(65) Prior Publication Data

US 2009/0023560 A1 Jan. 22, 2009

(30) Foreign Application Priority Data

Jul. 20, 2007 (GB) ..... 0714106.2

(51) Int. Cl.
*A63B 21/00* (2006.01)

(52) U.S. Cl. ..... 482/83; 482/87; 482/90; 473/441

(58) Field of Classification Search ..... D21/635, D21/399, 688, 787, 798; 482/83–90; 273/288, 273/291; 473/441–445; 446/226, 220
See application file for complete search history.

(56) References Cited

U.S. PATENT DOCUMENTS

| | | | | | |
|---|---|---|---|---|---|
| 61,180 | A | * | 1/1867 | Valin | 295/37 |
| 952,862 | A | * | 3/1910 | Armstrong | 482/85 |
| 1,007,628 | A | * | 10/1911 | Armstrong | 482/85 |
| 1,099,417 | A | | 6/1914 | Armstrong | |
| D175,717 | S | * | 10/1955 | fishlove | D21/399 |
| 2,909,370 | A | | 10/1959 | Fortney | |
| D262,471 | S | * | 12/1981 | Matsui | D21/399 |
| 6,030,271 | A | * | 2/2000 | Pietrafesa | 446/226 |
| 6,991,510 | B2 | * | 1/2006 | Nan | 446/220 |

FOREIGN PATENT DOCUMENTS

CN 2328394 Y 7/1999

* cited by examiner

*Primary Examiner* — Jerome w Donnelly
(74) *Attorney, Agent, or Firm* — Kilpatrick Townsend & Stockton LLP

(57) ABSTRACT

The present invention provides for exercise apparatus which can comprise general fitness or self-defense training apparatus having a base member; means arranged to define a first elongate member and a second elongate member extending upwardly therefrom; the first elongate member and the second elongate member being joined at, or by way of a target portion; wherein the base member is weighted relative to the elongate members and the target portion so as to seek to keep the elongate members in a substantially upright position.

24 Claims, 4 Drawing Sheets

TRAINING AND FITNESS APPARATUS

BACKGROUND OF THE INVENTION

The present invention relates to training and fitness apparatus and in particular to self defence training apparatus and equipment particularly for use in skill training for striking specific areas of the human body.

BRIEF SUMMARY OF THE INVENTION

A wide variety of exercises and equipment are used in the general improvement in fitness and/or to assist with weight-loss and to assist in learning and improving skills and techniques for a variety of sports, particularly in the field of contact sports, martial arts and self defence, when physical contact is required.

In particular, when learning and practicing striking techniques, for example kicks and punches, it is advantageous to use equipment which is designed to absorb the impact of a strike. Such equipment is typically in the form of weighted punch bags, or protective pads which can be carried or worn by a third person.

However, it is often desirable that the learnt techniques are practiced in an environment that more realistically simulates a real life scenario. To this end a variety of dummies, or mannequins, have been developed which simulate part, or whole of a human body so that the self defence techniques can be practiced and improved without potentially harming others.

For example, U.S. Pat. No. 6,110,079 describes a kick-boxing exercise device which includes a weighted base unit which supports the target section, the target section having the appearance of a head, neck and torso of the human body.

All such known apparatus is designed primarily for use in martial arts and boxing training, which focuses on strikes to the head and torso. However, self defence training, and particularly basic self defence training for women, includes several strikes which are not permitted in sports or competitive martial arts. One particular example of this is a self defence technique which involves a strike, normally in the form of a kick, or swift upward movement of the knee, to the groin of an assailant.

U.S. Pat. No. 4,088,315 discloses a device for use in self defence training, as in karate and the like, which includes a life-like articulated training dummy supported in an upright position on a post and having a plurality of separate pressure receptors disposed at various target locations in the dummy, including the groin. The disadvantage of such a device is the distribution of weight in the device and the position of the supporting post which makes kicking strikes to the groin difficult to achieve.

The present invention seeks to provide for exercise apparatus having advantages over known such apparatus and traditional training protocol.

In particular, the present invention seeks to provide exercise apparatus having the potential to more effectively train and practice self defence techniques which involve a strike to the groin area of the male human body in particular.

According to the present invention there is provided exercise apparatus comprising: at least one base member; means arranged to define a first elongate member and a second elongate member extending upwardly therefrom; the first elongate member and the second elongate member being joined at, or by way of a target portion; wherein the base member is weighted relative to the elongate members and the target portion so as to seek to keep the elongate members in a substantially upright position.

Advantageously, the base member has a substantially convex undersurface, so that the apparatus will naturally return to a substantially upright position after being struck when in use.

Preferably, the apparatus has a first and a second base member comprising: a first base portion having a substantially convex undersurface, and means arranged to define the first elongate member extending upwardly therefrom; and a second base portion having a substantially convex undersurface, and means arranged to define the second elongate member extending upwardly therefrom. Having a two bases, one for each elongate member, means that there is nothing obstructing the path between a users striking foot and the target portion.

Advantageously, the centre of gravity of the apparatus is below the top surface of at least one of the first or second base portions.

In a preferred embodiment, the first elongate member is shaped to have the appearance of a first human leg and the second elongate member is shaped to have the appearance of a second human leg.

It should be readily appreciated that the exercise apparatus can be adapted to comprise fitness exercise routine apparatus or a self defence exercise apparatus.

The target portion is preferably shaped to have the appearance of a human groin.

In order to make the apparatus look more like a human, the target portion preferably includes a third portion which is shaped to have the appearance of part or whole of a human torso.

Advantageously, the first base portion and the second base portion are movable in relation to each other, and preferably are arranged to be movable towards each other for storage of the apparatus. The first base portion and second base portion are preferably arranged to pivot about the target portion.

The first base portion and the second base portion can be made of a solid weighting material, but preferably are hollow and arranged to receive a quantity of weighting material.

In order to minimise the size of the apparatus when not in use, it is preferable that the third portion is inflatable.

The first elongate member and the second elongate member may also be inflatable, or alternatively they can be rigid, or hollow and arranged to receive a weighting material.

The whole of the apparatus may be inflatable, or alternatively the whole apparatus may be solid.

Advantageously, the apparatus has a weight less than the weight of an average male human adult.

In one embodiment the first elongate member and the second elongate member preferably comprise means for causing the apparatus to jump off the ground in response to a strike of the target portion, for example coiled springs in the first elongate member and the second elongate member.

In addition to a groin target portion, the apparatus may also include a throat target portion.

Preferably only the target portion is padded.

Also, a head portion can be provided with facial features such as at least a pair of eyes.

BRIEF DESCRIPTION OF THE DRAWINGS

The invention is described further hereinafter, by way of example only, with reference to the accompanying drawings in which.

DETAILED DESCRIPTION OF THE INVENTION

As it will be appreciated, the present invention provides for exercise apparatus and in the illustrated embodiment a self defence training exercise apparatus serving to assist in the training of techniques generally only used for fending off an assailant, in particular a male assailant.

The invention is particularly advantageous insofar as the apparatus is specifically designed to focus on the training of striking a region of a human that is not traditionally allowable in martial arts, namely the groin region, but which is a technique commonly taught in basic self defence classes for its effectiveness.

The figures described herein are illustrations of specific embodiments of a self defence training apparatus according to the present invention. However, it will be appreciated that the invention is not so limited to the embodiments as illustrated since it can be made from a variety of materials as appropriate, can include a variety of weighting means whether for the selected mounting of solid weights or otherwise and, while having a generally elongate form can be provided with extension portions that extend at any appropriate angle relative to the central portion.

Figure 1:
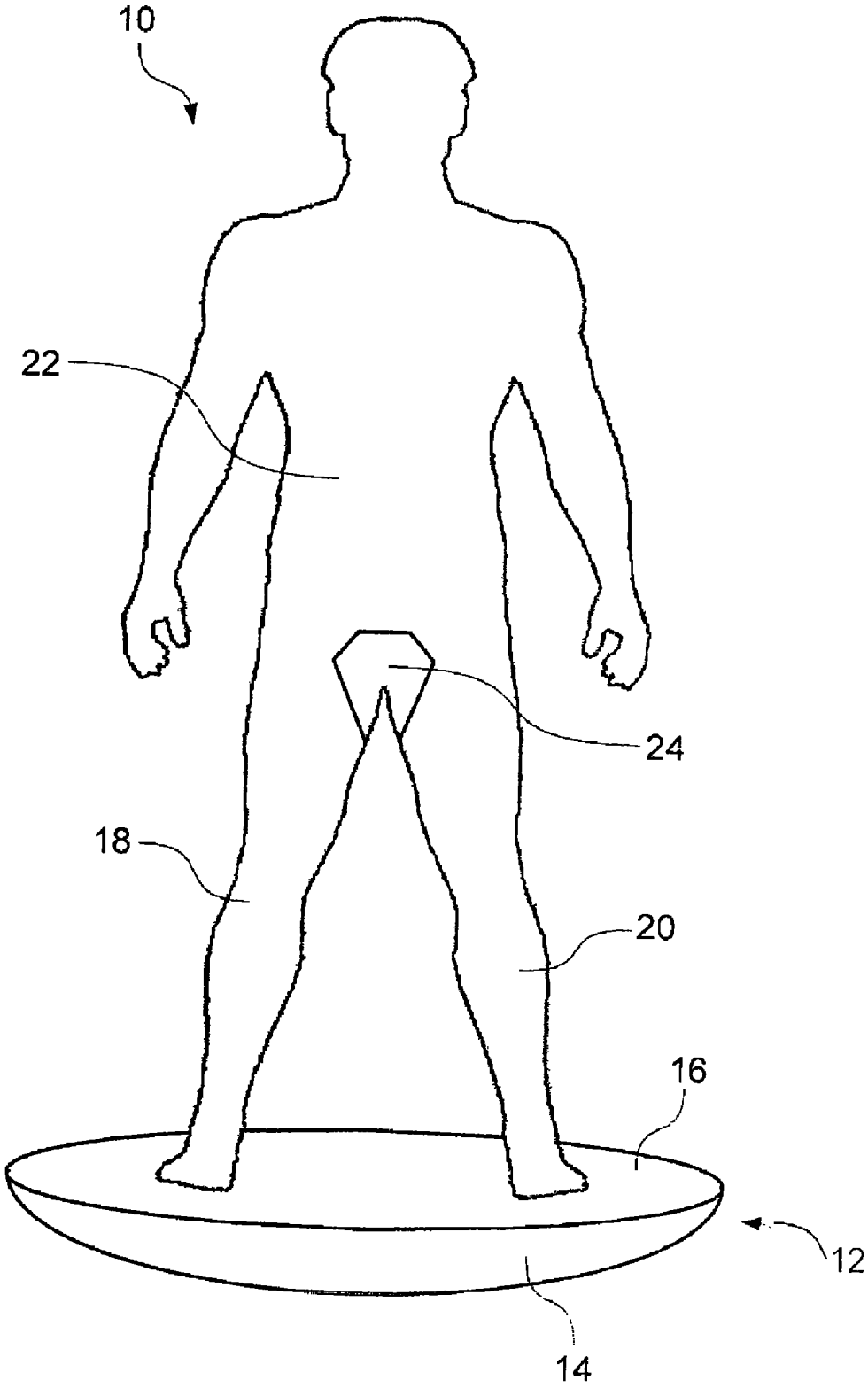
FIG. 1 is a front elevational view of an illustrative example of apparatus according to a first embodiment of the present invention.

Referring to FIG. 1, the training apparatus 10 preferably is in the form of a dummy or mannequin which has the appearance of the whole of, or at least the lower half of, a human adult male body.

The apparatus 10 comprises a base 12 having a lower surface 14 and an upper surface 16. A first elongated member 18 and a second elongated member 20 extend from the upper surface 16. The first and second elongate members 18, 20 are preferably shaped to resemble human legs. The first and second elongate members 18, 20 are connected to a third member 22, which in this example is shaped as a complete upper body including a torso, head and arms. There is also provided target region 24 on the third member 22 which is located in the region of the groin of the dummy. The target region 24 is typically made from softer material than that of the rest of the apparatus 10 for the comfort of the user.

An additional target region may also be provided in the neck region of the apparatus 10 for assisting in the training and practicing of another commonly taught basic self defence strike to the wind pipe of an assailant.

Although in this illustrative example the third member 22 comprises a torso, head and arms, it should be appreciated that the essential feature of the third member 22 is the target region 24 representative of a human groin.

The apparatus 10 is arranged to be self standing. The base 12 is weighted so as to keep the apparatus 10 in a generally upright position when in use. The base 12 can be solid and made from any suitable material, for example wood or metal. Alternatively the base 12 can be hollow and arranged to contain a sufficiently weighted fluid or a solid, for example water or sand.

The lower surface 14 of the base 12 comprises a convex rounded surface. This shape is advantageous in that it allows the apparatus 10 to automatically return to its normal, vertical position after being pushed or struck by a user, provided that the base 12 are sufficiently weighted to keep the centre of gravity of the apparatus above the base 12. The lower surface 14 in FIG. 1 is illustrated as being semi-spherical in shape, but in practice any rounded shape could be used.

It is preferable that the centre of gravity of the apparatus 10, when in use, is below the upper surface 16 of the base 12. This feature, in combination with the rounded, or spherical convex shape of the lower surface 14 of the base 12 advantageously means that the apparatus 10 will not only be self-standing, but it will also always return to an upright position regardless of the force exerted on the apparatus 10.

Figure 2:
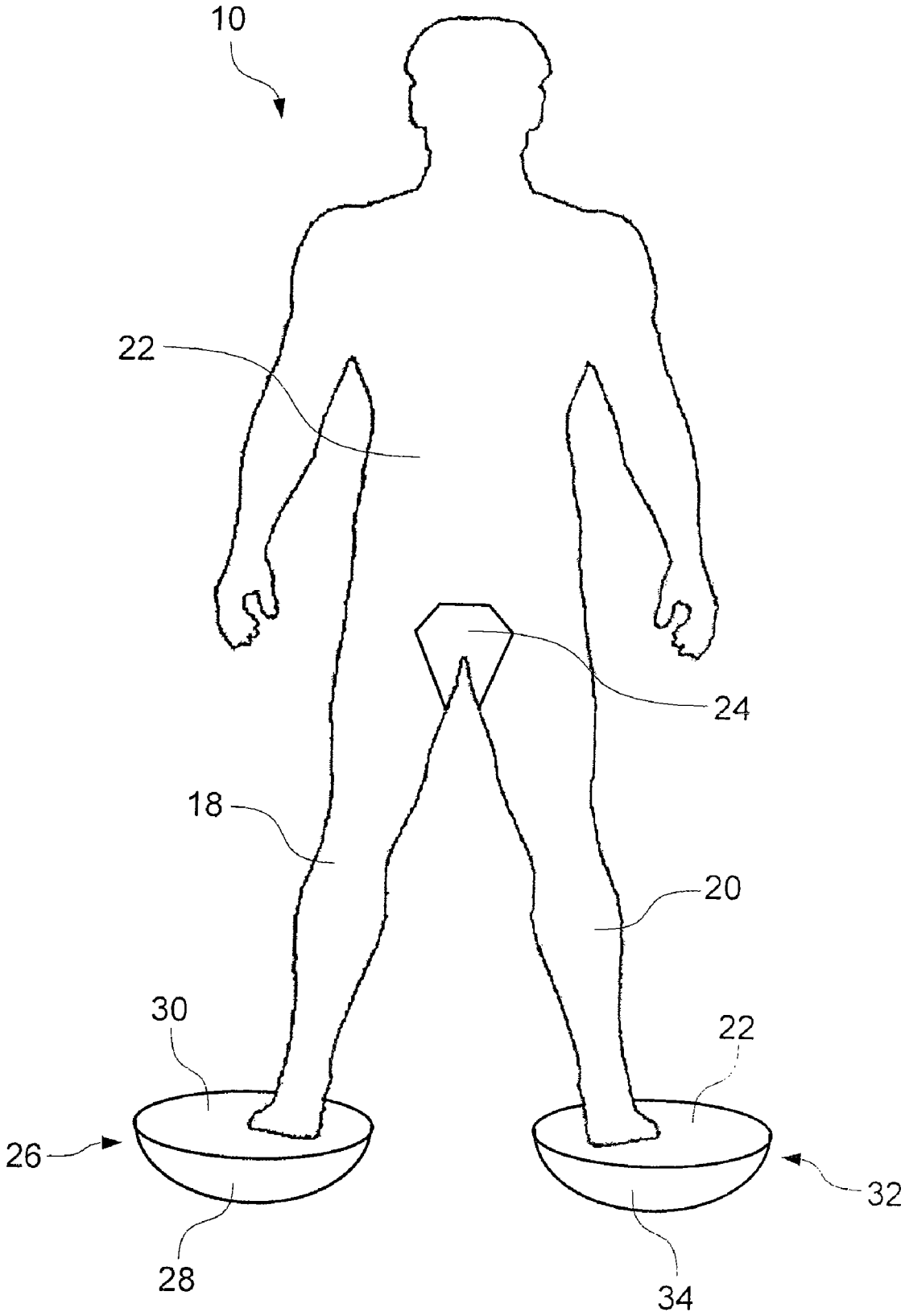
FIG. 2 is a front elevational view of an illustrative example of apparatus according to a second embodiment of the present invention.

FIG. 2 illustrates a second embodiment of the present invention wherein the apparatus comprises two separate bases 26, 32 rather than a single base. The apparatus 10 comprises a first base 26 having a lower surface 28 and an upper surface 30, and a second base 32 having lower surface 34 and an upper surface 36. The first elongate member 18 extends from the upper surface 30 of the first base 26, and the second elongate member 20 extends from the upper surface 36 of the second base 36.

The present invention is designed provide a more realistic experience of striking the groin area of a human than previously know apparatus. In this regard, when the apparatus is in use, the bases 26, 32 are positioned at a distance apart from each other approximate to the distance between a typical human's feet when standing. This allows the user to raise their foot between the elongate members 18, 20 representing legs without being obstructed by the bases 26, 32. Preferably, the distance between the bases 26, 32, and therefore the angle between the elongated members 18, 20 can be adjusted to vary the difficulty of striking the target 24 with the user's foot. It is also preferable that the first base 26 and the second base 32 can be arranged adjacent to one another for storage of the apparatus 10.

Figure 3:
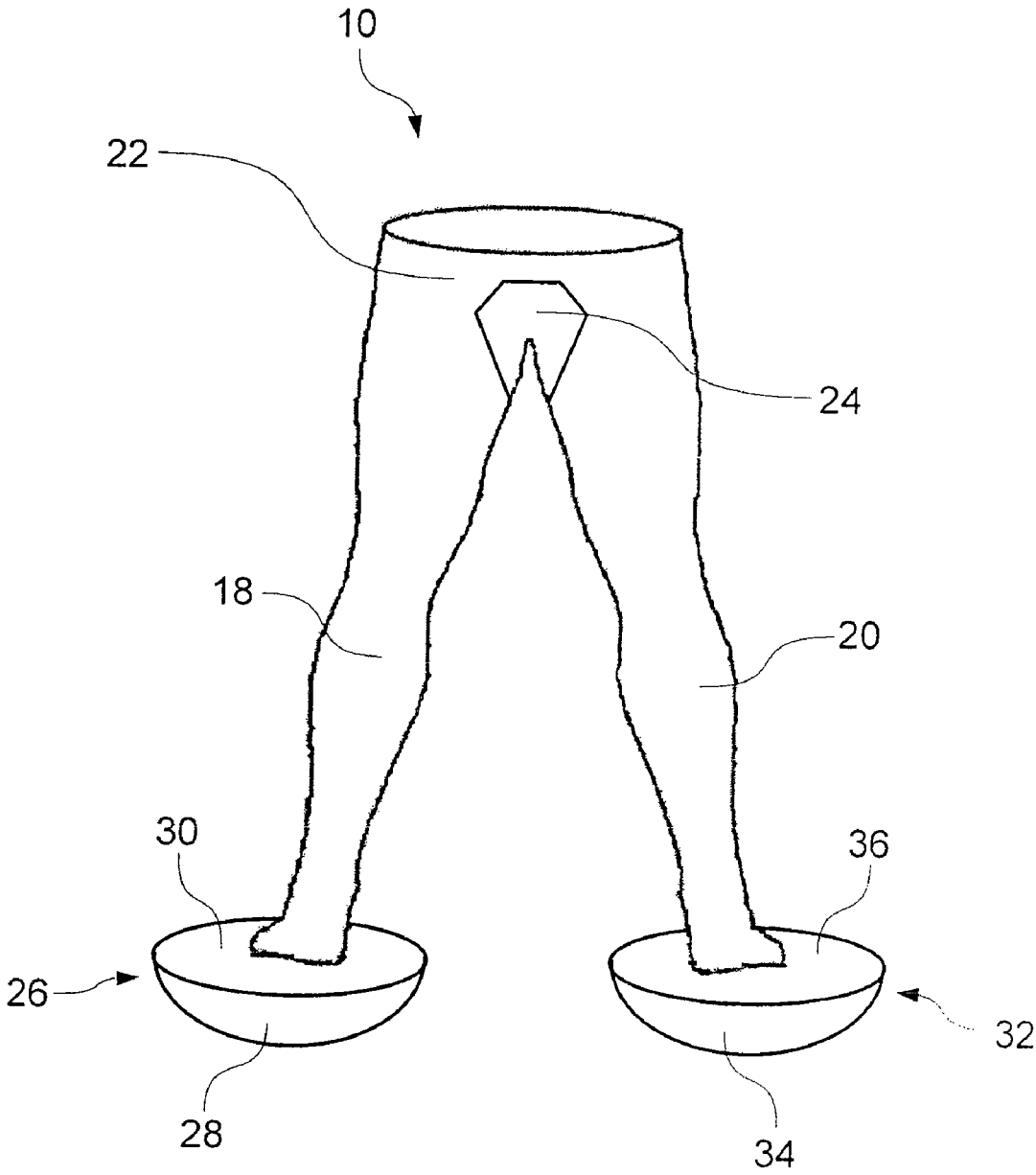
FIG. 3 is a front elevational view of an illustrative example of apparatus according to a third embodiment of the present invention.

FIG. 3 is an illustration of a third embodiment of the present invention having features identical to those of the lower half of FIG. 2. In this example, the third member 22 comprises only the target section 24. This is advantageous in that the physical size of the apparatus 10 is reduced enabling easier storage and it would also be cheaper to produce because less material is used in manufacture.

Figure 4:
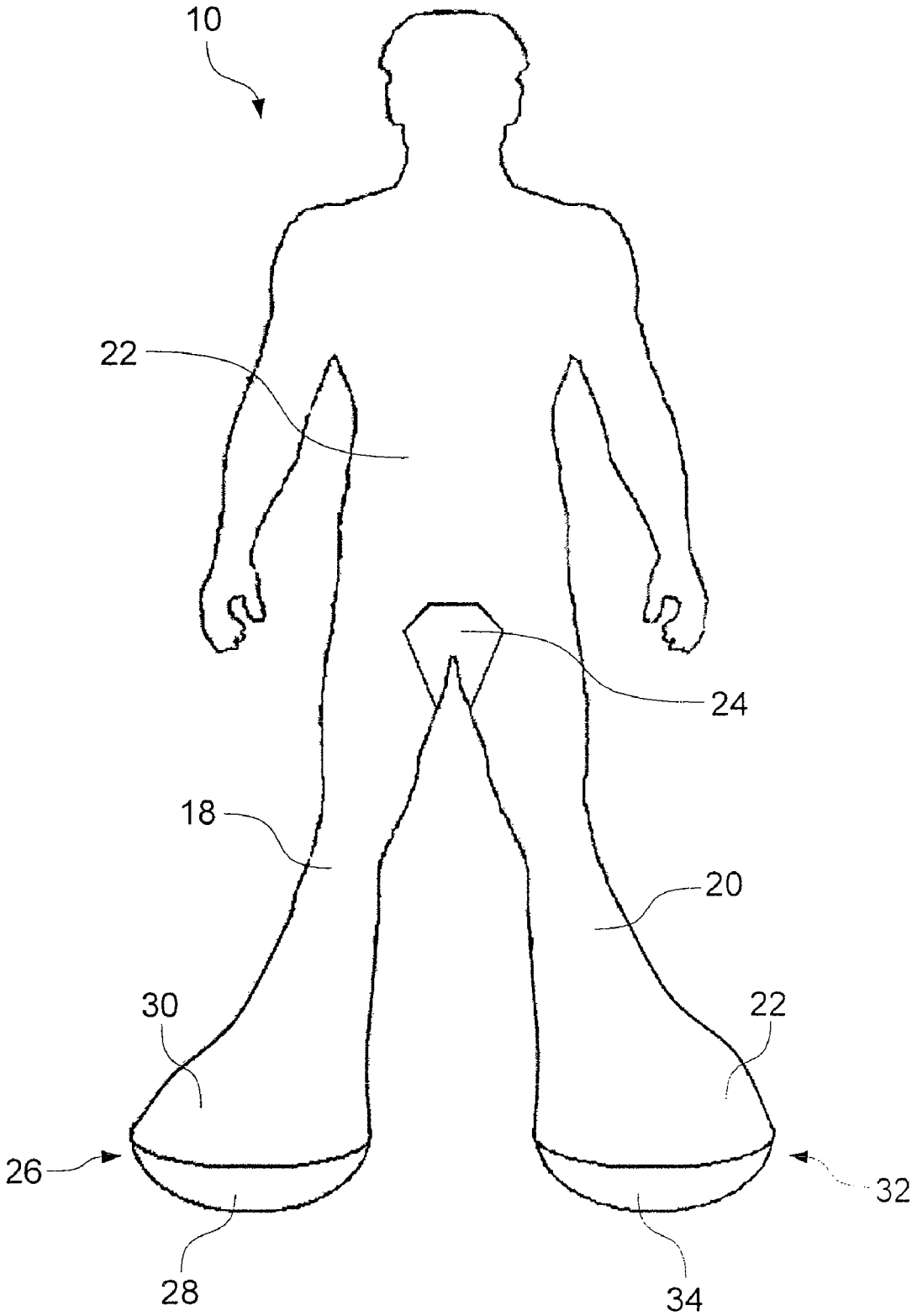
FIG. 4 is a front elevational view of an illustrative example of apparatus according to a forth embodiment of the present invention.

FIG. 4 is an illustration of an inflatable apparatus 10 according to the present invention. The principal components are the same as those shown in FIG. 2. The only difference in appearance is that the two elongate members 18, 20 representing the legs cover the entire surface of their respective bases 12, 18. This advantageously increases the strength of the elongate members 18, 20 and prevents them from undesirably bending when inflated.

The present invention may also include one or more means for making the apparatus automatically move in response to a strike of the target area 24. The force required to automatically move the apparatus 10 can be generated using any known moving means, for example one or more electric motors or coiled springs in the base 12;26;32 or elongated members 18, 20. The moving means can be triggered either mechanically or electronically by sensors in the target 24.

The self defence apparatus 10 can be formed of any appropriate material, either as a unitary moulded member or otherwise. Advantageously the apparatus can be made partly or wholly from leather or canvas material such as that used for conventional punch-bags. The apparatus 10, or a section of the apparatus 10 can also be inflatable for easier transportation and storage, for example just the third member 28 comprising the target region 30 could be inflatable, or alternatively the elongate members 24, 26 can also be inflatable.

Of course any appropriate configuration and limb size and shape can be provided for the apparatus and the invention is not restricted to the details of the foregoing embodiment.

What is claimed is:

1. Exercise apparatus comprising:

a first base member having a first weight;

a second base member having a second weight;

a first elongate member that extends upwardly from the first base member, and a second elongate member that extends upwardly from the second base member;

the first elongate member and the second elongate member together having a third weight and being joined at, or by way of a target portion that has a fourth weight;

wherein the first and second weights of the base members when combined is greater relative to the combined third and fourth weights such that the center of gravity of the exercise apparatus is below a top surface of the first and second base members and the first and second weights of the base members maintain the exercise apparatus in a substantially upright position where the target portion is vertically above at least one of the first and second base members and will automatically return the exercise apparatus to the upright position after striking or pushing of the target portion by a user;

wherein the first base member comprises a first base portion having a substantially convex undersurface;

wherein the second base member comprises a second base portion having a substantially convex undersurface; and wherein the substantially convex undersurfaces of the base portions also maintain the elongate members in the substantially upright position until striking or pushing of the target portion by the user.

2. An apparatus according to claim 1, wherein the first and second elongate members are joined to their respective base members.

3. An apparatus according to claim 1, wherein the first and second elongate members are integrally formed with their respective base members.

4. An apparatus according to claim 1, wherein the centre of gravity is below the top surface of the base member.

5. An apparatus according to claim 1, wherein the first elongate member is shaped to have the appearance of a first human leg and the second elongate member is shaped to have the appearance of a second human leg.

6. An apparatus according to claim 1, wherein the target portion is shaped to have the appearance of a human groin.

7. An apparatus according to claim 1, wherein the target portion includes a third portion.

8. An apparatus according to claim 1, wherein the third portion is shaped to have the appearance of part or whole of a human torso.

9. An apparatus according to claim 3, wherein the first base portion and the second base portion are movable in relation to each other.

10. An apparatus according to claim 9, wherein the first base portion and the second base portion are arranged to be moved towards each other for storage of the apparatus.

11. An apparatus according to claim 9, wherein the first base portion and the second base portion are arranged to pivot about the target portion.

12. An apparatus according to claim 1, wherein the base member is hollow and arranged to receive a quantity of weighting material.

13. An apparatus according to claim 7, wherein the third portion is inflatable.

14. An apparatus according to claim 1, wherein the first elongate member and the second elongate member are rigid.

15. An apparatus according to claim 1, wherein the first elongate member and the second elongate member are hollow.

16. An apparatus according to claim 1, wherein the first elongate member and the second elongate member are inflatable.

17. An apparatus according to claim 1, having a total weight less than the weight of an average male human adult.

18. An apparatus according to claim 1, wherein the first elongate member and the second elongate member comprise means for causing the apparatus to jump off the ground in response to a strike of the target portion.

19. An apparatus according to claim 18, wherein said means for causing the apparatus to jump off the ground comprises at least one coiled spring in the first elongate member and the second elongate member.

20. An apparatus according to claim 1, and including a groin target portion and a throat target portion.

21. An apparatus according to claim 1 wherein only the target portion is padded.

22. An apparatus as claimed in claim 1 and comprising fitness training apparatus.

23. An apparatus as claimed in claim 1, and comprising self-defence training apparatus.

24. Exercise apparatus comprising:

a first base member having a first weight;

a second base member having a second weight;

a first elongate member that extends upwardly from the first base member, and a second elongate member that extends upwardly from the second base member, the first elongate member and the second elongate member together having a third weight;

the first elongate member and the second elongate member being joined at, or by way of a target portion having a fourth weight;

wherein the first and second weights of the base members when combined are greater relative to the combined third and fourth weights of the elongate members and the target portion such that the center of gravity of the exercise apparatus is below a top surface of the first and second base members and the first and second weights of the base members maintain the exercise apparatus in a substantially upright position where the target portion is vertically above at least one of the first and second base members and will automatically apparatus to the upright position after striking or pushing of the target portion by a user, wherein the first base member comprises a first base portion having a substantially convex undersurface;

wherein the second base member comprises a second base portion having a substantially convex undersurface; and wherein the substantially convex undersurfaces of the base portions and the base portions also maintain the elongate members in the substantially upright position until striking or pushing of the target portion by a user.

* * * * *